US007484570B2

(12) United States Patent
Andersson et al.

(10) Patent No.: US 7,484,570 B2
(45) Date of Patent: Feb. 3, 2009

(54) PERCUSSION DEVICE

(75) Inventors: Kurt Andersson, Tyresö (SE); Jörgen Rodert, Saltsjö-Boo (SE)

(73) Assignee: Atlas Copco Rock Drills AB, Orebro (SE)

( * ) Notice: Subject to any disclaimer, the term of this patent is extended or adjusted under 35 U.S.C. 154(b) by 142 days.

(21) Appl. No.: 11/663,167

(22) PCT Filed: Sep. 28, 2005

(86) PCT No.: PCT/SE2005/001426

§ 371 (c)(1),
(2), (4) Date: Mar. 19, 2007

(87) PCT Pub. No.: WO2006/043866

PCT Pub. Date: Apr. 27, 2006

(65) Prior Publication Data

US 2007/0267223 A1 Nov. 22, 2007

(30) Foreign Application Priority Data

Oct. 20, 2004 (SE) ..... 0402527

(51) Int. Cl.
*B25D 9/14* (2006.01)

(52) U.S. Cl. ..... 173/207; 173/135; 173/206; 91/220; 91/239; 91/300; 91/321

(58) Field of Classification Search ..... 173/206, 173/207, 208, 135, 13, 17, 137, 138, 15, 173/119; 91/220, 239, 300, 321, 246, 274, 91/276, 308

See application file for complete search history.

(56) References Cited

U.S. PATENT DOCUMENTS 3,774,502 A * 11/1973 Arndt ..... 91/246
3,965,799 A 6/1976 Juvonen et al.
4,006,665 A * 2/1977 Klemm ..... 91/278
4,006,783 A * 2/1977 Granholm ..... 173/177
4,020,746 A * 5/1977 Arndt ..... 91/291
4,034,817 A * 7/1977 Okada ..... 173/207
4,179,983 A * 12/1979 Wallace ..... 92/85 B (Continued)

FOREIGN PATENT DOCUMENTS

WO 04/073931 9/2004

*Primary Examiner*—Scott A. Smith
(74) *Attorney, Agent, or Firm*—Mark P. Stone

(57) ABSTRACT

Percussion device including a machine housing (1), a forwards and backwards movable percussion piston (2) in the machine housing, and a reciprocatingly movable tubular valve body (6) inside the machine housing, said percussion piston (2) being arranged to subject a tool (3) to impact, and said percussion piston including a first (4) and a second (5) driving surface arranged to be pressurized in order to drive the percussion piston forwards and backwards, said valve body (6) including a first end surface (12) and a second end surface (13), wherein pressurizing the first end surface (12) tends to drive the valve body in a first direction and pressurizing the second end surface (13) tends to drive the valve body in a second direction, whereby the valve body (6) is arranged, over a channel (7) arranged in the machine housing, to connect at least the second (5) of the driving surfaces alternately to a pressure source (8) or to low pressure (9), wherein an inner room (31) in the tubular valve body (6) is continuously connected to the low pressure (9) over at least one-opening (32) through an envelope surface of the valve body (6).

1 Claim, 1 Drawing Sheet

U.S. PATENT DOCUMENTS 4,230,019 A * 10/1980 Castejon Castan ..... 91/220
4,291,771 A * 9/1981 Perraud ..... 173/106
4,800,797 A * 1/1989 Comarmond ..... 91/307
4,817,737 A * 4/1989 Hamada et al. ..... 173/115
4,899,836 A 2/1990 Vernot
5,392,865 A * 2/1995 Piras ..... 173/17
5,979,291 A 11/1999 Juvonen
7,174,824 B2 * 2/2007 Koskimaki et al. ..... 91/218

* cited by examiner

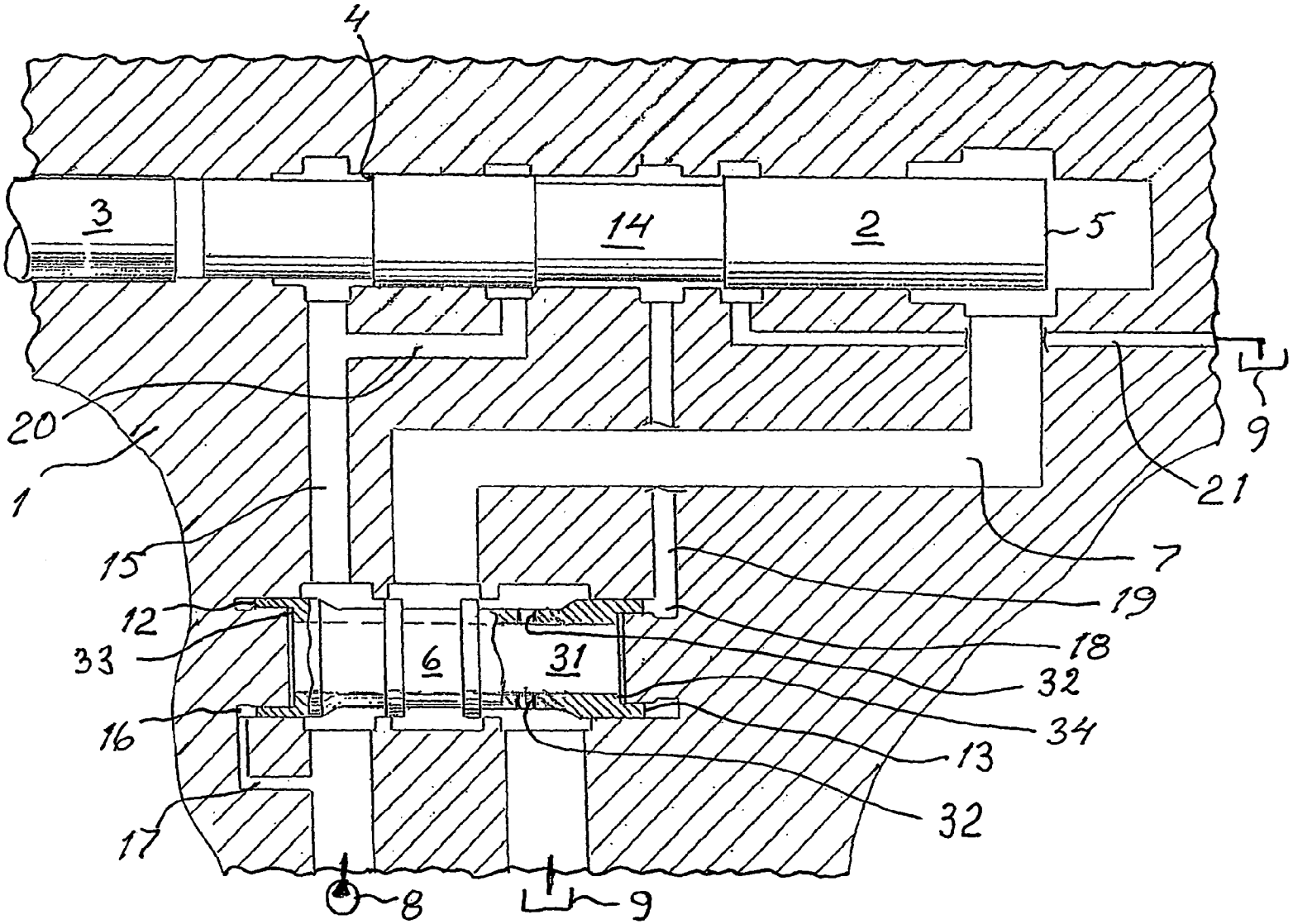
9
21
7
19
18
32
34
13
32
5
2
14
31
9
6
8
4
3
20
1
15
12
33
16
17

PERCUSSION DEVICE

The present invention relates to a percussion device of the kind that is included in rock drilling machines.

In a previously known percussion device of this kind, see U.S. Pat. No. 5,372,196, it has proved to be difficult to achieve a sufficiently fast valve change-over in order to be able to work at the high frequencies that are desired in modern high performance drilling. An essential reason for this is that the liquid, which is present in an inner room inside the tubular valve body is slowed down when the valve body moves forwards and backwards in the machine housing. This is due to the fact that the end surfaces of the valve body are effected by the pressure in differently large volumes, so that liquid is pumped into and out from a relatively long conduit.

The present invention, as defined in the following claim, aims at creating a percussion device with fast valve change-over that is suitable for high performance drilling.

An embodiment of the invention is described below with reference to the annexed drawing which schematically shows a section through a percussion device according to the invention.

The percussion device shown on the drawing includes a machine housing 1, wherein a percussion piston 2 is movable forwards and backwards in order to subject a tool 3 to impacts. The tool is as usual provided with a here not shown drill bit. The percussion piston is provided with a first driving surface 4 which is continuously pressurized from a pressure source 8 over a channel 15. The percussion piston is further provided with a second driving surface 5, which in the shown embodiment is comprised of the rear surface of the percussion piston. The driving surface 5 is alternately connected to the pressure source 8 or to the low pressure of the tank 9 over a channel 7 and a valve body 6 being reciprocatingly movable in the machine housing. In the shown embodiment, pressurizing of the first driving surface 4 drives the percussion piston to the right in the figure. Since the area of the second driving surface 5 is essentially larger than the area of the first driving surface 4, pressurizing of the driving surface 5 results in that the percussion piston is driven to the left in the figure against the effect of the pressure acting on the driving surface 4. The valve body 6 is constructed as a tubular slide having a first end surface 12 which is subjected to the pressure in the first chamber 16. The chamber 16 is over the channel 17 in connection with the pressure source 8. The valve body 6 is further provided with a second end surface 13, which is subjected to the pressure in a second chamber 18. The chamber 18 is over the channel 19 connected to the cylinder bore of the percussion piston 2. The pressure in the channel 19 is controlled by the percussion piston 2, which is provided with a portion 14 having a reduced diameter. When the percussion piston 2 is positioned somewhat to the left of the position in the figure, the channel 19 is in connection with the pressure source 8 over the channels 15 and 20. The valve body 6 is then pressed to the left in the figure. When the percussion piston 2 reaches the position shown in the figure, the connection of the channel 19 with the pressure source 8 has been broken and a connection with the channel 21 and thereby low pressure 19 started to open. Hereby the pressure in the chamber 18 is reduced so that the pressure in the chamber 16 presses the valve body 6 to the right in the figure. The valve body 6 is provided with an inner room 31 which over a number of openings 32 in the envelope surface is continuously in connection with low pressure 9. The valve body 6 is provided with a first end area 33 and a second end area 34. Since, the end area 33 is larger than the end area 34, the movement of the valve body 6 results in that liquid must be brought away from or brought to the inner room 31. Since the inner room 31 is connected to low pressure 9 over openings 32, a very fast pressure change is obtained in the inner room 31, so that the movement of the valve body 6 is not slowed down unnecessarily. Hereby fast valve change-over is ensured.

The invention claimed is:

1. Percussion device including a machine housing, a forwards and backwards movable percussion piston in the machine housing, and a reciprocatingly movable tubular valve body inside the machine housing, said percussion piston being arranged to subject a tool to impact, and said percussion piston including a first and a second driving surface arranged to be pressurized in order to drive the percussion piston forwards and backwards, said valve body including a first end surface and a second end surface, wherein pressurizing the first end surface tends to drive the valve body in a first direction and pressurizing the second end surface tends to drive the valve body in a second direction, whereby the valve body is arranged, over a channel arranged in the machine housing, to connect at least the second of the driving surfaces alternately to a pressure source or to low pressure, wherein an inner room in the tubular valve body is continuously connected to the low pressure over at least one opening through an envelope surface of the valve body.

* * * * *